US006040849A

United States Patent [19]

McIntyre et al.

[11] Patent Number: 6,040,849

[45] Date of Patent: Mar. 21, 2000

[54] INSERTABLE THERMAL PRINTER CARTRIDGES FOR DIGITAL CAMERA

[75] Inventors: Dale F. McIntyre, Honeoye Falls; Loretta E. Allen, Hilton, both of N.Y.

[73] Assignee: Eastman Kodak Company, Rochester, N.Y.

[21] Appl. No.: 09/199,291

[22] Filed: Nov. 24, 1998

[51] Int. Cl.[7] ..... B41J 3/36; B41J 32/00

[52] U.S. Cl. ..... 347/214; 396/429; 396/310

[58] Field of Search ..... 347/214; 400/207, 400/208, 208.1; 396/429, 310

[56] References Cited

U.S. PATENT DOCUMENTS

| | | | |
|---|---|---|---|
| 4,702,631 | 10/1987 | Watanabe . | |
| 4,901,090 | 2/1990 | Ozawa et al. | 347/214 |
| 4,914,452 | 4/1990 | Fukawa | 347/214 |
| 4,982,209 | 1/1991 | Pearson . | |
| 5,875,034 | 2/1999 | Shintani et al. | 347/171 |

FOREIGN PATENT DOCUMENTS

98/18253 10/1997 WIPO .

*Primary Examiner*—Huan Tran

*Attorney, Agent, or Firm*—Raymond L. Owens

[57] ABSTRACT

An insertable thermal printer cartridge for insertion into a digital camera or the like includes a housing for receiving a plurality of receivers each of which is adapted to receive colorant, and a donor supply roll for supplying a donor having colorant to a colorant transfer area and a donor take-up spool for receiving donor after colorant has been transferred. The receivers and the donor are respectively moved to the colorant transfer area where colorant is transferred from the donor to the receiver, and the housing including identifying contacts which, after the insertable thermal printer cartridge has been inserted into the device, which provide an electrical connection to identify the type of receiver and donor in the inserted insertable thermal printer cartridge and further defining a cavity for mounting at least one battery which is adapted to provide power for moving the donor and receivers and for supplying power for colorant transfer at the colorant transfer area.

5 Claims, 9 Drawing Sheets

INSERTABLE THERMAL PRINTER CARTRIDGES FOR DIGITAL CAMERA

CROSS REFERENCE TO RELATED APPLICATIONS

Reference is made to commonly assigned U.S. patent application Ser. No. 09/198,746 filed concurrently herewith entitled "Insertable Cartridge for Digital Camera with Ink Jet Printer" to Dale F. McIntyre et al., and U.S. patent application Ser. No. 09/198,745 filed concurrently herewith entitled "Battery Control for Digital Camera and Integral Printer" to Dale F. McIntyre et al.,.

FIELD OF THE INVENTION

This invention relates to insertable thermal printer cartridges which can be useable in digital cameras which further include thermal printers.

BACKGROUND OF THE INVENTION

Heretofore, images of high quality have been produced by thermal printers. In a typical thermal printer, an image is formed in three passes. First a dye donor having colorant such as yellow is placed in dye transfer relationship with a receiver and then the dye donor is heated in a pattern corresponding to the yellow portion of an image to be completed. Thereafter, cyan and magenta portions of the image are formed in a similar fashion. The completed color image on the receiver is continuous tone and in many cases can rival photographic quality.

In one type of thermal printer which prints color images, a donor contains a repeating series of spaced frames of different colorants such as heat transferable dyes. The donor is disposed between a receiver, such as coated paper, and a print head formed of, for example, a plurality of individual heating resistors. When a particular heating resistor is energized, it produces heat and causes dye from the donor to transfer to the receiver. The density or darkness of the printed color dye is a function of the energy delivered from the heating element to the donor.

Thermal dye transfer printers offer the advantage of true "continuous tone" dye density transfer. This result is obtained by varying the energy applied to each heating element, yielding a variable dye density image pixel in the receiver.

Thermal printers, as known in the computer printing art, have replaceable donor insertable thermal printer cartridges. These insertable thermal printer cartridges are capable of containing large volumes of donor necessary for printing many receivers which can be sheets of 8½ by 11 inch coated paper. These insertable thermal printer cartridges, or their derivatives, are not suitable for inclusion in a digital camera as they are far too large. Additionally, the amount of donor per printed image is a variable depending upon the image to be printed and the size of the image to be printed with respect to the size of the receiver. Therefore, desktop printers teach the separation of the insertable thermal printer cartridges containing receivers from the insertable thermal printer cartridges containing donor material. In a digital camera, such a system has many inherent and undesirable limitations. First and most obvious is the complexity of having to load both a donor insertable thermal printer cartridge in one location and also a supply of receivers. Furthermore, cameras don't typically have interface and software means to input a user's change in receivers. Additionally, undesirable prints can be created by the wrong combination of donor and receiver placing an unnecessary burden on the user. An example of a portable thermal wax transfer printer not included within a digital camera that exhibits this problem is the Model GV-HT1 portable printer manufactured by JVC which requires a user to load an insertable donor cartridge as well as a separate supply of receivers.

Recently, ALPS Electric Co. has produced a very small thermal printer mechanism for integration into a digital camera. This printer, model PTML1101A has a mating insertable thermal printer cartridge that contains both donor in the form of a roll as well as small receivers positioned in the insertable thermal printer cartridge to receive dye from the donor by way of resistive heating elements in the printer. Resistive heating elements are very inefficient means for supplying the colorant sublimation energy and therefore place an unusually large burden on the power supply of the digital camera.

SUMMARY OF THE INVENTION

It is an object of the present invention to provide an insertable insertable thermal printer cartridge which permits a thermal printer within a digital camera to more effectively produce color images.

These objects are achieved by an insertable thermal printer cartridge for insertion into a digital camera or the like, comprising:

a) a housing for receiving a plurality of receivers each of which is adapted to receive colorant;

b) a donor supply roll for supplying a donor having colorant to a colorant transfer area and a donor take-up spool for receiving donor after colorant has been transferred;

c) means for serially moving the receivers and the donor from the donor supply roll to the colorant transfer area where colorant is transferred from the donor to the receiver; and d) the housing including identifying contacts which, after the insertable thermal printer cartridge has been inserted into the device, which provide an electrical connection to identify the type of receiver and donor in the inserted insertable thermal printer cartridge and further defining a cavity for mounting at least one battery which is adapted to provide power for the moving means and for supplying power for colorant transfer at the colorant transfer area.

ADVANTAGES

It is an advantage of the present invention to provide a single insertable thermal printer cartridge with all the replaceable elements necessary for creating a print by a thermal printer included in a digital camera.

It is a further advantage to insure that the apparatus accepting the insertable thermal printer cartridge is not burdened by the power consumption of the printing operation as this is provided by at least one battery within the insertable thermal printer cartridge itself. The energy for the capture portion of the digital camera is powered by a separate battery contained within the digital camera.

A feature of the invention is that the use of conductive identifying contacts can be sensed by the electronics in the digital camera to provide an indication to the user of the type of insertable thermal printer cartridge being inserted. Information such as the exact color gamut of dyes and the number of receiver sheets can also be provided to the digital camera by these conductive identifying contacts.

DETAILED DESCRIPTION OF THE INVENTION

Figure 5:
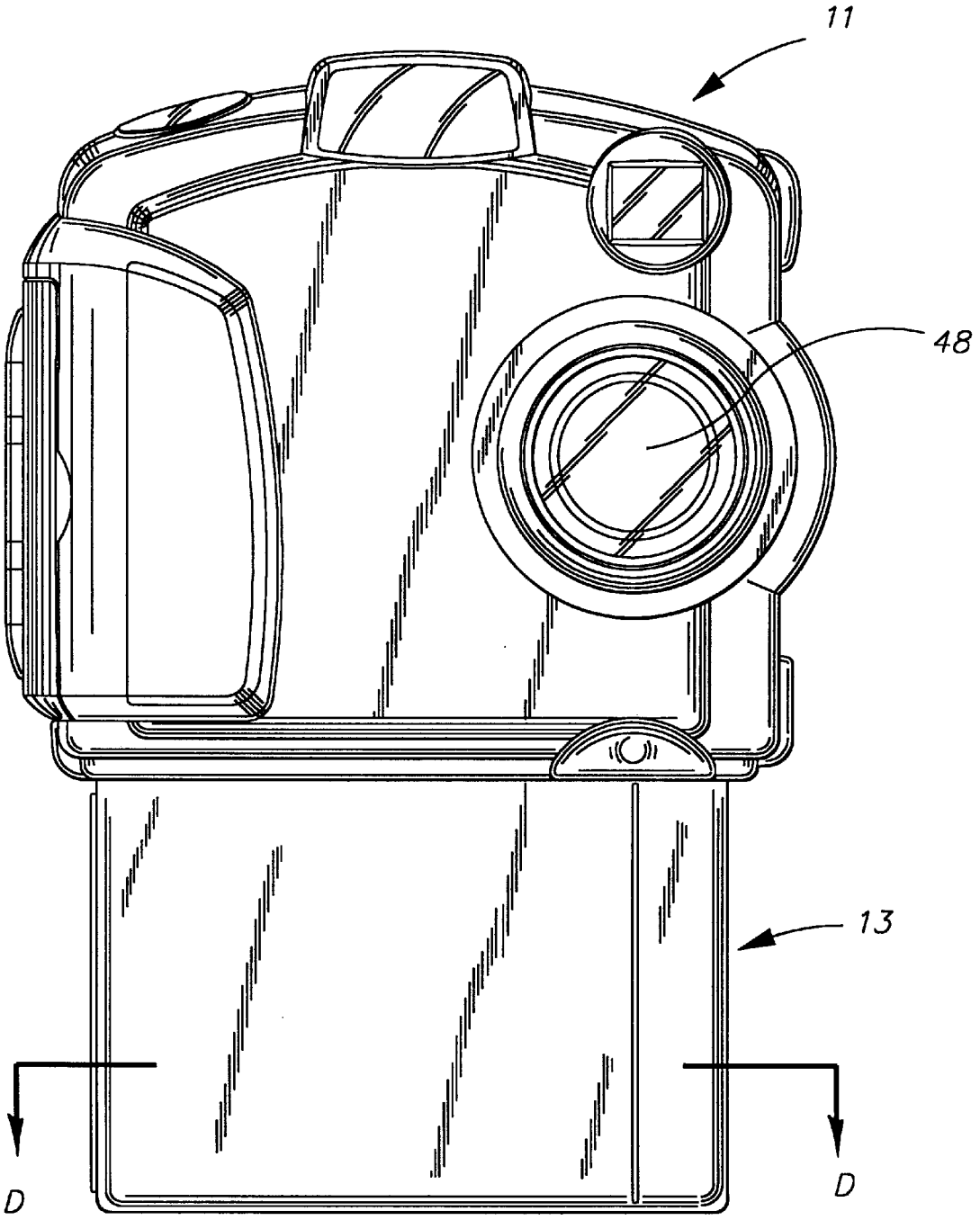
FIG. 5 is a front view of a digital camera having a thermal printer for receiving the insertable, thermal printer cartridge of FIG. 1.

The overall structure of the present invention will briefly be reviewed with respect to FIGS. 5 and 6. The present invention uses an insertable thermal printer cartridge 10 which is inserted into a digital camera 11. The digital camera 11 includes a thermal printer 13. Further features of the digital camera 11 and thermal printer 13 will be discussed later.

Figure 1:
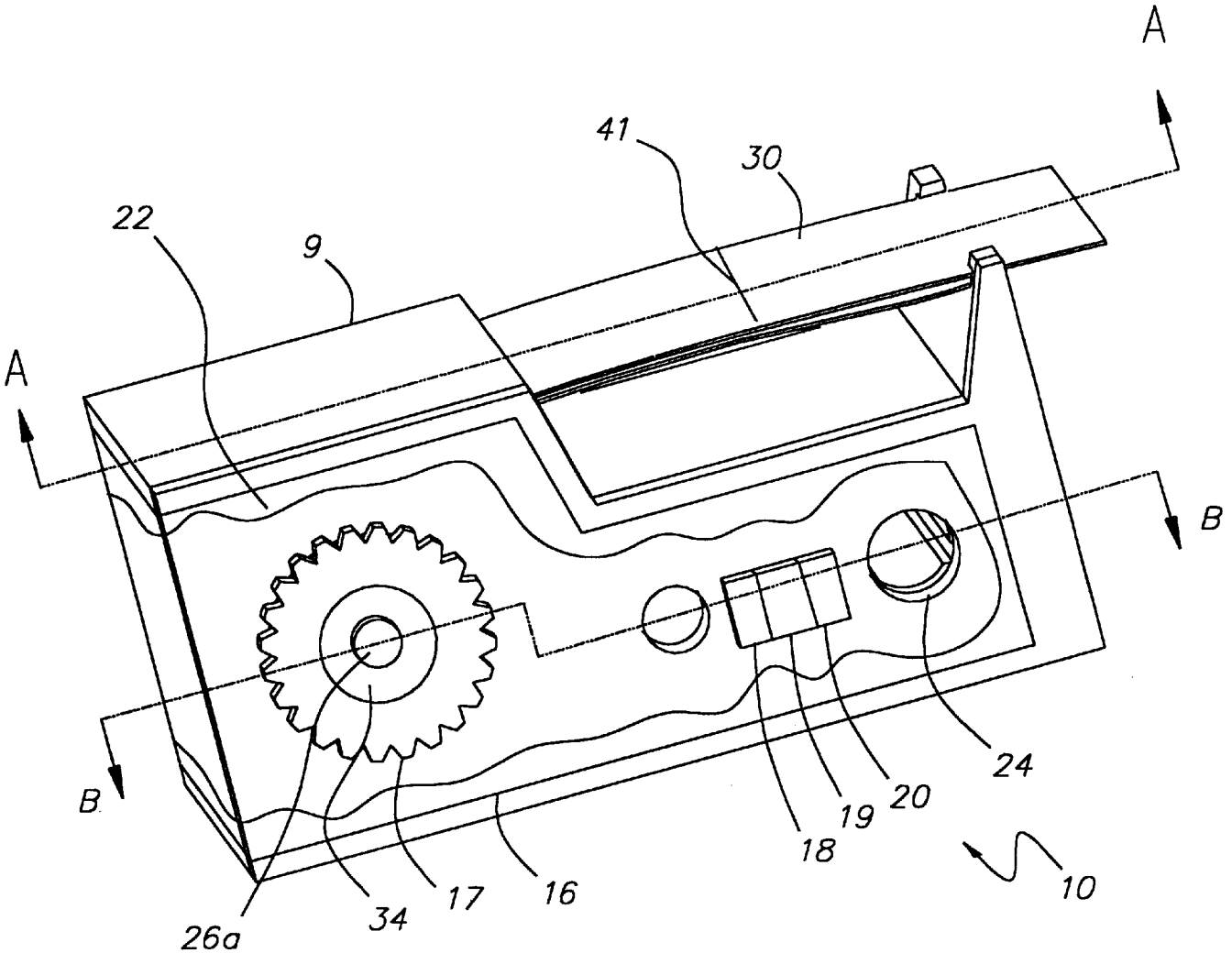
FIG. 1 is a perspective of an insertable thermal printer cartridge with receiver drive sprocket and identifying contacts for use with a digital camera having a thermal printer.

Turning now to FIG. 1, a perspective of an insertable thermal printer cartridge 10 is shown with a section of a receiver 30 extending from an insertable thermal printer cartridge housing 9. The insertable thermal printer cartridge housing 9 is provided with a removable cartridge seal 16 which protects identifying contacts 18, 19, and 20, receiver drive sprocket 17, and batteries 34 prior to use of the insertable thermal printer cartridge 10. In this manner, features of the insertable thermal printer cartridge 10 such as identifying contacts 18, 19, and 20 are protected from damage. Similarly, batteries 34 are protected from accidental discharge while the receiver drive sprocket 17 is prevented from unintentionally advancing receivers 30. Cartridge seal 16 can be of a Mylar sheet held in position until use by a conventional, low tack adhesive 22 as cartridge seal 16 is used only as protective seal. The cartridge seal 16 is removed prior to inserting the insertable thermal printer cartridge 10 into insertable thermal printer cartridge bay 10*a* provided in the digital camera 11 (see FIG. 8). It will be understood that the cartridge seal 16 can contain human readable data printed on the outer surface (not shown) indicative of the date of manufacture, expiration date, printer compatibility, etc. Alignment features are assembled in the housing 9 and shown as a donor take-up spool 24 and the receiver drive sprocket 17 which are used in the positioning of insertable thermal printer cartridge 10 into thermal printer 13.

Identifying contacts 18, 19, and 20 can be formed by the application of an encoded and patterned metallized tape. Each identifying contact 18, 19, and 20 may be metallized or not forming a conductive or non-conductive area. These identifying contacts 18, 19, and 20 provide information of features of the inserted insertable thermal printer cartridge 10 to the thermal printer 13 in the digital camera 11. These identifying contacts 18, 19, and 20 provide information in a manner similar to the DX encodement of 35 mm film cassettes. For example, see commonly assigned U.S. Pat. No. 4,982,209 to Pearson. The identifying contacts 18, 19, and 20 are used by the thermal printer 13 of the digital camera 11 to sense the data represented by the encoded conductive pattern. Such data can represent the manufactured configuration of the insertable thermal printer cartridge 10 with respect to the preloaded receivers 30 such as white opaque receivers or transparent receivers, donor supply batch number, and quantity of receivers 30 as shown in Table 1 below.

TABLE 1

| Insertable thermal printer cartridge Details | Identifying Contact 20 | Identifying Contact 19 | Identifying Contact 18 |
|---|---|---|---|
| Opaque Receivers/Batch 1234 (24) | L | L | L |
| Opaque Receivers/Batch 1234 (36) | L | L | H |
| Opaque Sticker Receivers/Batch 1234 (24) | L | H | L |
| Opaque Sticker Receivers/Batch 1234 (36) | L | H | H |
| Transparent Receivers/Batch 1234 (24) | H | L | L |
| Transparent Receivers/Batch 1234 (36) | H | L | H |
| Transparent Sticker Receivers/Batch 1234 (24) | H | H | L |
| Transparent Sticker Receivers/Batch 1234 (36) | H | H | H |

L = Low Level Voltage, H = High Level Voltage

Logic levels shown in Table 1 describe the identification of the contents of insertable thermal printer cartridge 10 with respect to the type and quantity of receivers 30. The amount of donor 21 provided during manufacture of a donor supply roll 23 and is determined in accordance with the number of receivers to be printed. The identification is accomplished by identifying probe pairs 52, 54, and 56 (see FIG. 4) contacting identifying contacts 18, 19, and 20 respectively, for the purpose of determining the conductivity of each identifying contact 18, 19, and 20. Identifying probe pairs 52, 54, and 56 are electrically controlled by circuitry (not shown) within the insertable thermal printer cartridge interface and printer actuator electronics block 46. Typically, a small current will flow across the discrete elements of identifying probe pairs 52, 54, and 56 causing a Low Level Voltage to be sensed by insertable thermal printer cartridge interface and printer actuator electronics block 46 if the identifying contact was conductive. If current does not flow across the probe pairs, the identifying contact was not conductive and a High Level Voltage is sensed by insertable thermal printer cartridge interface and printer actuator electronics block 46. The identification information is used by the insertable thermal printer cartridge interface and printer actuator electronics block 46 to produce a superior resultant printed image.

It should be obvious to one skilled in the art that additional identifying contacts can be used within the scope of the invention as well as other combinations of receivers 30 and donor 21 which are likely to be desired by users of the apparatus.

Figure 2:
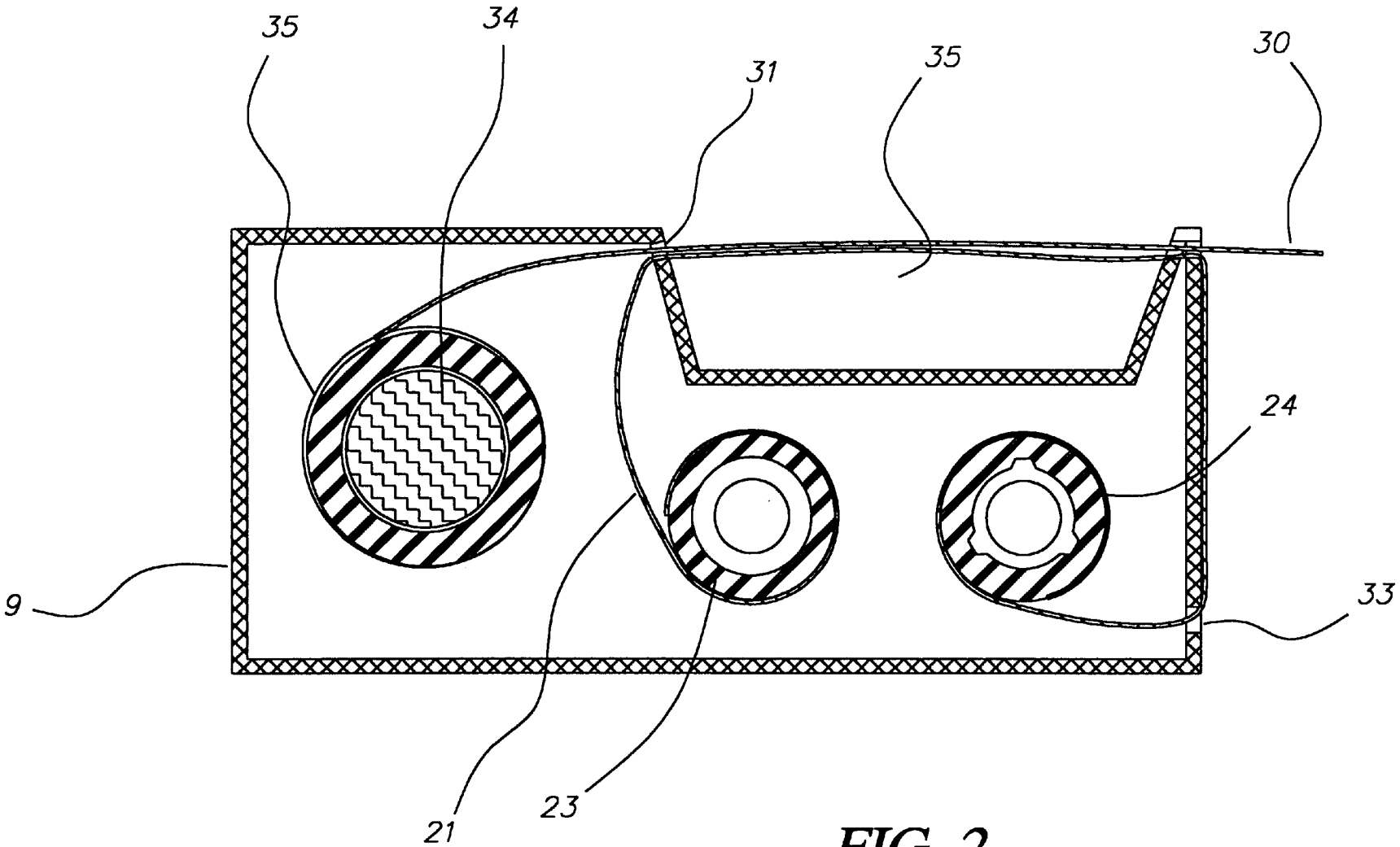
FIG. 2 is, a sectional view of the insertable thermal printer cartridge of FIG. 1 taken along lines A—A showing the relative position of the donor supply roll, donor take-up spool and receiver supply roll.
Figure 7:
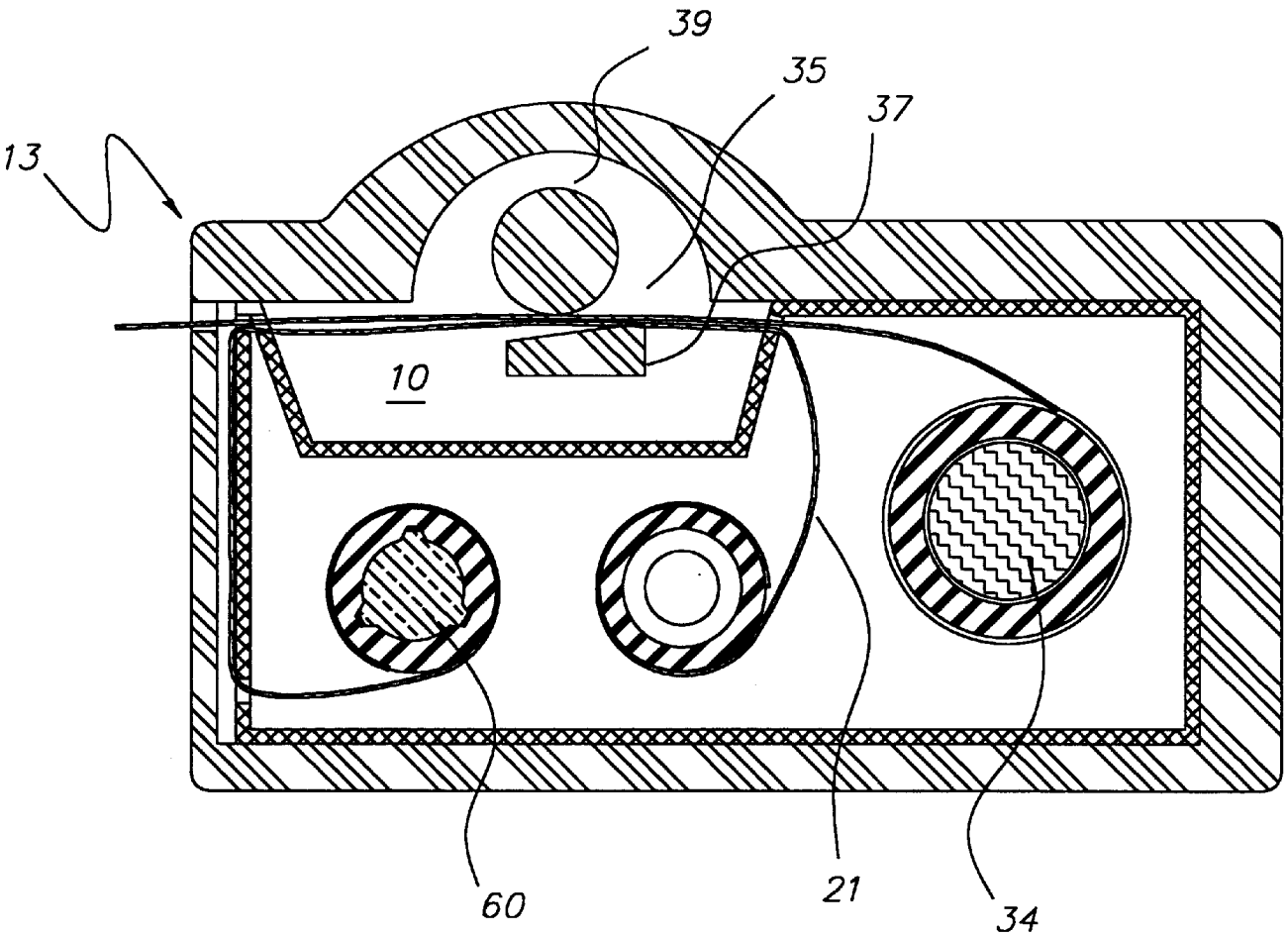
FIG. 7 is a sectional view taken along lines D—D of the printer of FIG. 5 showing in cross section an insertable thermal printer cartridge inserted into the thermal printer of the digital camera.

Turning now to FIG. 2 which is a cross-section of the insertable thermal printer cartridge 10, there is a receiver supply spool 25 upon which is loaded receivers 30 for receiving colorants from donor 21 during the ad operation of thermal printer 13 (see FIG. 7). Donor supply roll 23 is shown loaded with donor 21 which is also connected to donor take-up spool 24. To reach the donor take-up spool 24, the donor 21 must pass out of insertable thermal printer cartridge housing 9 by leaving through an insertable thermal printer cartridge egress slot 31. Donor 21 is then moved to a colorant transfer area 35 before re-entering the insertable thermal printer cartridge housing 9 through an insertable thermal printer cartridge ingress slot 33. This arrangement is pre-assembled into the insertable thermal printer cartridge housing 9 during the manufacturing of the insertable thermal printer cartridge 10. In a similar fashion, receivers 30 also leave insertable thermal printer cartridge housing 9 through insertable thermal printer cartridge egress slot 31 and enter the colorant transfer area 35 in relative proximity to donor 21.

Figure 3:
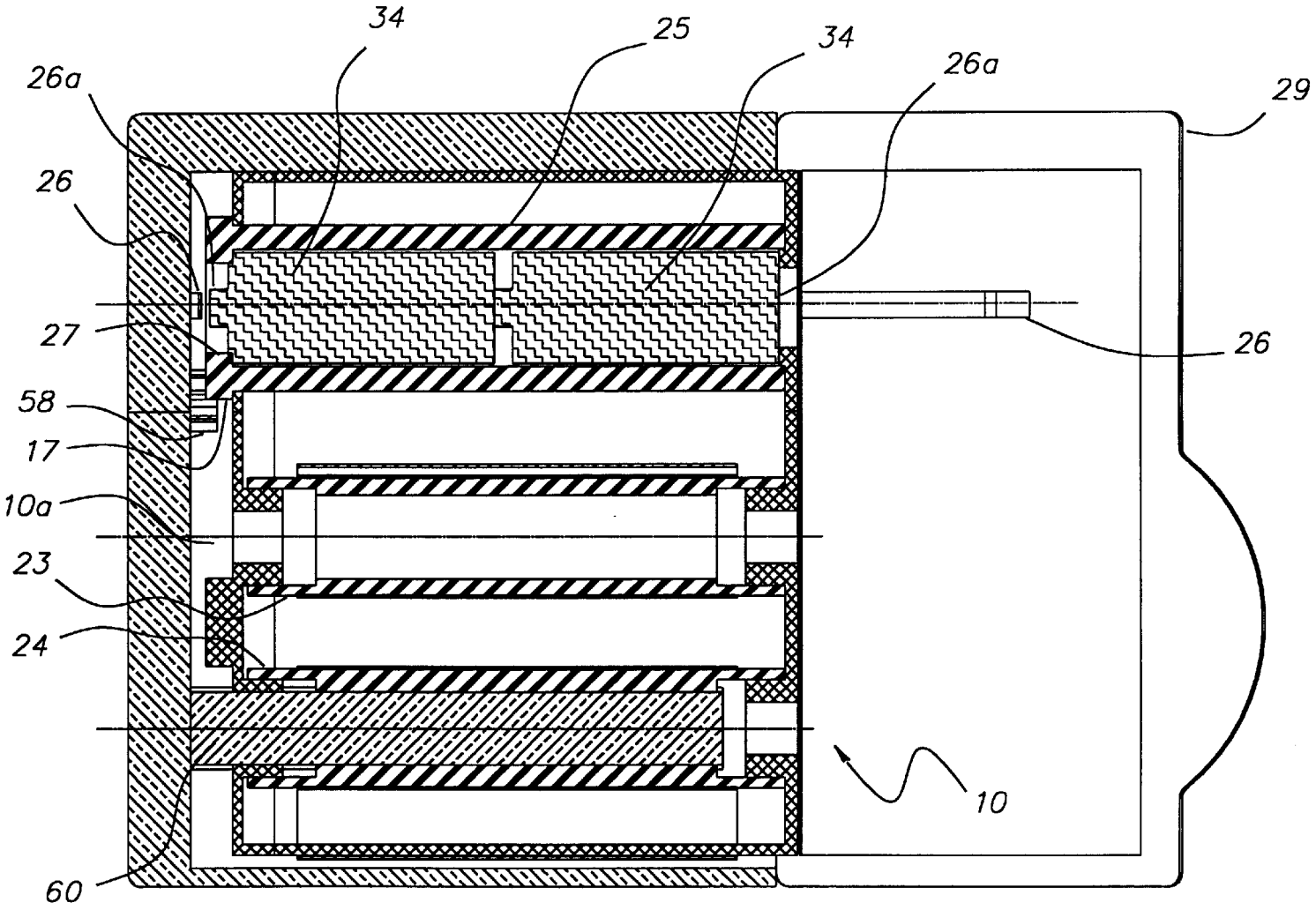
FIG. 3 is sectional view of the insertable thermal printer cartridge within the thermal printer taken along lines B—B showing donor supply roll, donor take-up spool, receiver supply roll, batteries, and identifying contacts.

FIG. 3 is a cross sectional view taken along lines B—B of FIG. 1 which depicts the arrangement of the receiver supply spool 25, donor supply roll 23, donor take-up spool 24, batteries 34, and cartridge battery contacts 26. The receiver supply spool 25 defines a cavity 27 in which batteries 34 are provided. Battery contacts 26*a* on batteries 34 are accessable through openings in the insertable thermal printer cartridge housing 9 for electrical connection to printer actuator and drive electronics block 46 (see FIG. 4). Cartridge battery contacts 26 are formed within the thermal printer 13 on opposite sides of insertable thermal printer cartridge bay 10*a*. One such cartridge battery contact 26 is formed in the back wall of insertable thermal printer cartridge bay 10*a*. An insertable thermal printer cartridge bay door 29 is shown in an open position to reveal the other cartridge battery contact 26 that is formed on the insertable thermal printer cartridge bay door 29.

The insertable thermal printer cartridge bay door 29 pivots axially around a hinge 28 (see FIG. 8) to move from a closed operational position where the cartridge battery contacts 26 engage battery contacts 26*a*, to an open position for insertion of the insertable thermal printer cartridge 10 into the insertable thermal printer cartridge bay 29 of thermal printer 13. In the preferred embodiment, the batteries 34 can be lithium batteries such as the 3-Volt KCR2 batteries sold by the Eastman Kodak Company.

A receiver drive mechanism 58 and a donor drive shaft 60 are also shown as features of the thermal printer 13. As the insertable thermal printer cartridge 10 is inserted into the thermal printer 13, the receiver drive mechanism 58 of thermal printer 13 mechanically couples with the receiver drive sprocket 17 of insertable thermal printer cartridge 10. In a similar fashion, the donor drive shaft 60 of thermal printer 13 mechanically couples with the donor take-up spool 24 of insertable thermal printer cartridge 10.

Figure 4:
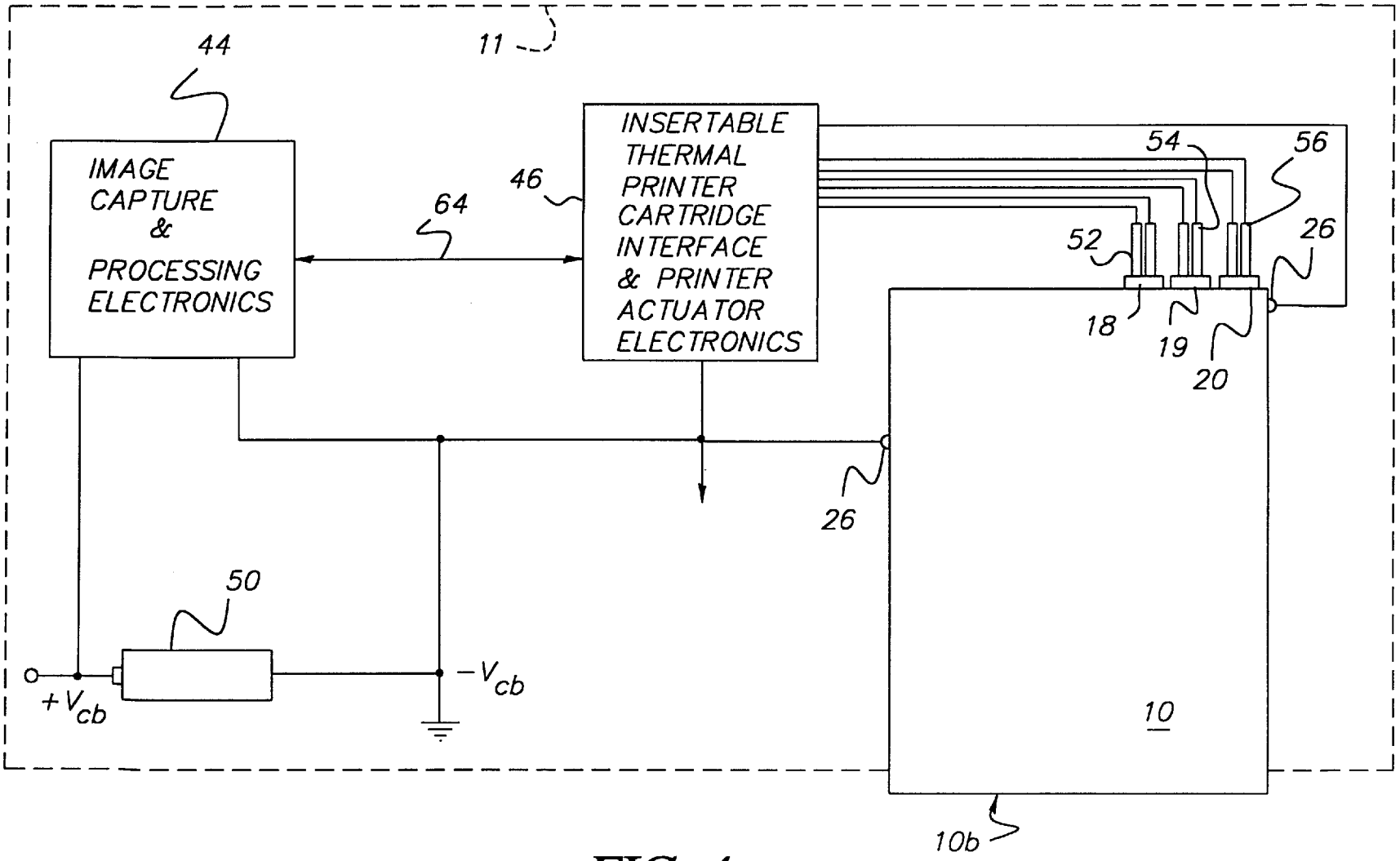
FIG. 4 is a block diagram of the electronic interconnection of the insertable thermal printer cartridge to the thermal printer and the capture and imaging processing electronics.

Turning now to FIG. 4, an image capture and processing electronics block 44 is shown which is included in the digital camera 11. The image capture and processing electronics block 44 will be understood to include all the necessary elements to acquire and store images electronically via an image sensor (not shown) as is found in well known digital camera apparatus such as the DC-260 digital camera manufactured by the Eastman Kodak Company.

The insertable thermal printer cartridge 10 is shown inserted into digital camera 11 in the direction of arrow 10*b*. Battery contacts 26*a* are exposed through openings on each side of insertable thermal printer cartridge 10 making an electrical connection between the insertable thermal printer cartridge 10 and the power supply voltages denoted as +Vcb and −Vcb which are provided by a digital camera battery 50 to supply electrical power to the thermal printer 13 of the digital camera 11 and the insertable thermal printer cartridge interface and printer actuator electronics block 46. In such a manner, the user is always assured that the necessary power to print an image is available each time an insertable thermal printer cartridge 10 is loaded. The cartridge battery contacts 26 are not shown in actual physical relationship to each other. Rather, they are shown in a general sense for simplicity. Image data, addressing data, and control data necessary for the printing operation travel between the image capture and processing electronics block 44 and the insertable thermal printer cartridge interface and printer actuator electronics block 46 along a data bus 64.

FIG. 5 shows a front view of the digital camera 11 includes a lens 48 and an image sensor (not shown) both of which are controlled by the image capture and processing electronics block 44 and furthermore captures a digital image. The image capture and processing electronics block 44 stores the captured image in a digital format and processes such image for use by the thermal printer 13.

Figure 6A:
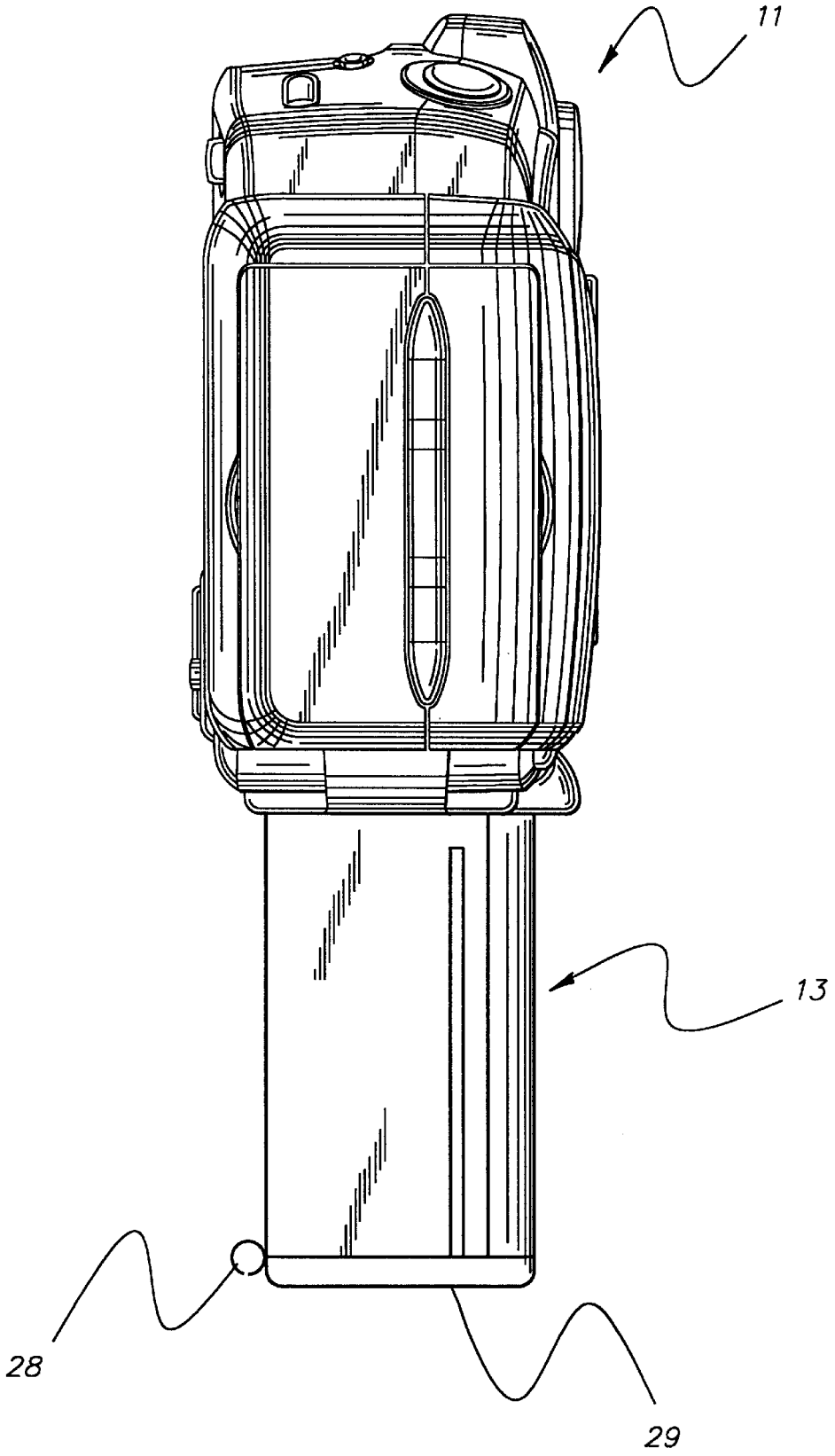
FIGS. 6*a* and 6*b* are side views of the digital camera of FIG. 5.
Figure 6B:
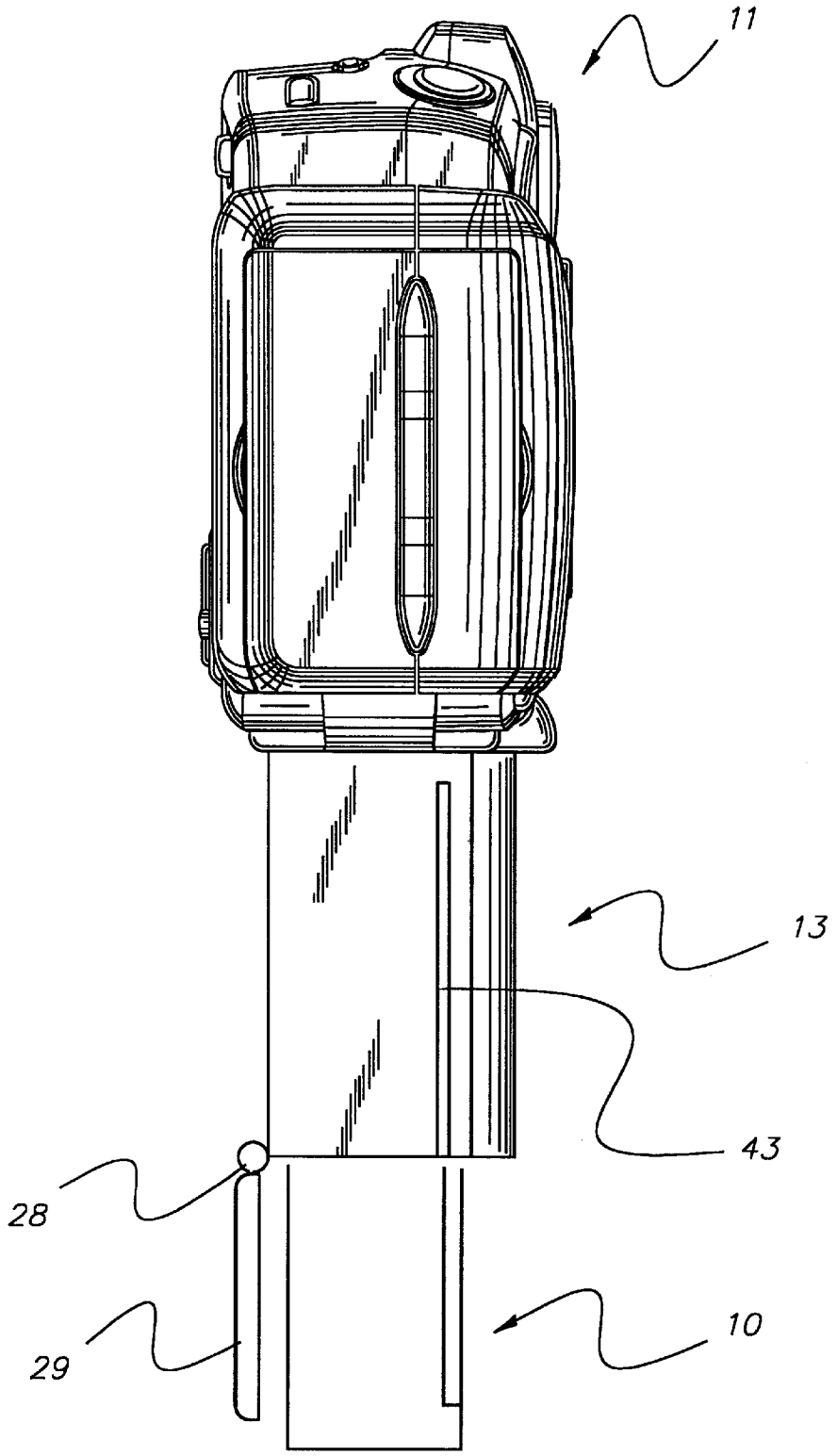

Turning to FIGS. 6A and 6B, the digital camera 11 is shown from a side view with included thermal printer 13 again in a general fashion. FIG. 6A shows the arrangement of FIG. 5 as side view with insertable thermal printer cartridge bay door 29 in the closed operational position where the cartridge battery contacts 26 engage battery contacts 26*a*. FIG. 6B shows a similar view with insertable thermal printer cartridge bay door 29 in an open position for insertion of the insertable thermal printer cartridge 10 into the insertable thermal printer cartridge bay 29 of thermal printer 13.

FIG. 7 is a sectional view taken along lines D—D of FIG. 5 which shows the insertable thermal printer cartridge 10 loaded into thermal printer 13. In this figure, the receivers 30 are shown in proximate position to donor 21 with respect to a thermal head 37 in the colorant transfer area 35. In a manner well known in the art, receivers 30 are moved relative to the donor 21 for the purposes of receiving colorant at predetermined positions through a plurality of conventional heating elements (not shown) which are included in the thermal head 37. Pressure roller 39 of the thermal printer 13 works in cooperation with the thermal head 37 to maintain proper contact and alignment between donor 21 and receivers 30 to effectively create a color print.

Figure 8:
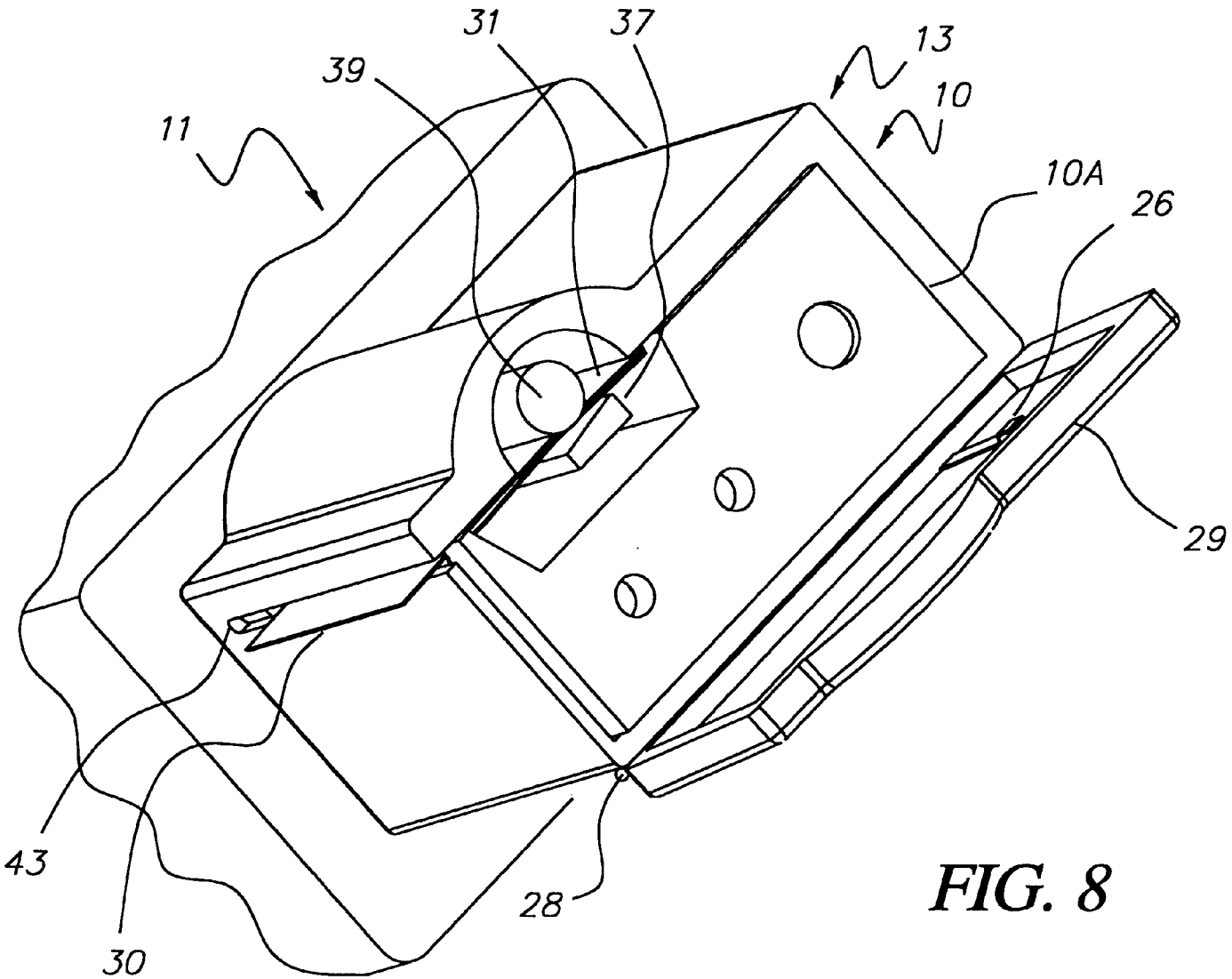
FIG. 8 is an exploded perspective view of the insertable thermal printer cartridge being inserted into the thermal printer of the digital camera.

Turning now to FIG. 8, insertable thermal printer cartridge 10 is shown protruding from insertable thermal printer cartridge bay 10*a* with insertable thermal printer cartridge bay door 29 in an open position for insertion of the insertable thermal printer cartridge 10 into the insertable thermal printer cartridge bay 29 of thermal printer 13. Receivers 30 are shown relative to pressure roller 39, donor 21 (not visible), and thermal head 37. Receiver 30, while receiving colorant transferred from donor 21 via thermal head 37, must leave the thermal printer 13 through a printer egress slot 43. In a manner well known in the art, receiver 30 moves in and out of the printer egress slot 43 to accommodate a plurality of printing operations wherein a single colorant is transferred from donor 21 to receiver 30 in each operation. The colorants to be transferred can be the commonly used CYMK colorant scheme.

In operation, the cartridge seal 16 is removed from the insertable thermal printer cartridge 10. The insertable thermal printer cartridge 10 is inserted into the insertable thermal printer cartridge bay 10*a* which has features corresponding to the insertable thermal printer cartridge housing 9 for mounting the insertable thermal printer cartridge 10. Identifying contacts 18, 19, and 20 provide feature information to the insertable thermal printer cartridge interface and printer actuator electronics block 46 for controlling the operation of the thermal printer 13 as shown in FIG. 4. Receivers 30 on receiver supply spool 25 are caused to advanced by the insertable thermal printer cartridge interface and printer actuator electronics block 46 which actuates the receiver drive mechanism 58 which is mechanically coupled to the receiver drive sprocket 17 (see FIG. 1). In a similar fashion, donor 21 is caused to be moved from the donor supply roll 23 onto the donor take-up spool 24 by the insertable thermal printer cartridge interface and printer actuator electronics block 46 which actuates the donor drive shaft 60 which is mechanically coupled to the donor take-up spool 24. The receiver drive mechanism 58 and donor drive shaft 60 each include driving mechanisms located in the thermal printer 13 (not shown), which continuously advance the receiver and donor relative to the heating elements of the thermal head 37. As will be clear to those skilled in the art, the motors in the mechanisms can be continuous DC motors.

It will be understood that receivers 30 are temporarily connected along the length of receivers 30 by orthogonal lines of perforations 41 (see FIG. 1) permitting the color print to be conveniently detached from unused receivers 30 within insertable thermal printer cartridge 10.

The invention has been described in detail with particular reference to certain preferred embodiments thereof, but it will be understood that variations and modifications can be effected within the spirit and scope of the invention.

PARTS LIST

9 insertable thermal printer cartridge housing
10 insertable thermal printer cartridge
10*a* insertable thermal printer cartridge bay
10*b* arrow
11 digital camera
13 thermal printer
16 cartridge seal
17 receiver drive sprocket
18 identifying contact
19 identifying contact
20 identifying contact
21 donor
22 adhesive
23 donor supply roll
24 donor take-up spool
25 receiver supply spool
26 cartridge battery contact
26*a* battery contact
27 cavity
28 hinge
29 insertable thermal printer cartridge bay door
30 receivers
31 insertable thermal printer cartridge egress slot
33 insertable thermal printer cartridge ingress slot
34 battery
35 colorant transfer area
37 thermal head
39 pressure roller
41 perforations PARTS LIST (con't)

43 printer egress slot
44 image capture and processing electronics block
46 insertable thermal printer cartridge interface and printer actuator electronics block
48 lens
50 digital camera battery
52 identifying probe pair
54 identifying probe pair
56 identifying probe
58 receiver drive mechanism
60 donor drive shaft
64 data bus

What is claimed is:

1. An insertable thermal printer cartridge for insertion into a digital camera or the like, comprising:

a) a housing for receiving a plurality of receivers each of which is adapted to receive colorant;

b) a donor supply roll for supplying a donor having colorant to a colorant transfer area and a donor take-up spool for receiving donor after colorant has been transferred;

c) means for serially moving the receivers and the donor from the donor supply roll to the colorant transfer area where colorant is transferred from the donor to the receiver; and d) the housing including identifying contacts which, after the insertable thermal printer cartridge has been inserted into the camera, which provide an electrical connection to identify the type of receiver and donor in the inserted insertable thermal printer cartridge and further defining a cavity for mounting at least one battery which is adapted to provide power for the moving means and for supplying power for colorant transfer at the colorant transfer area.

2. In a digital camera having a thermal printer and such camera being adapted to receive a thermal printer insertable cartridge, the thermal printer including a printhead for transferring heat at a colorant transfer area and means for activating the printhead to cause colorant to transfer from a donor to a receiver at the colorant transfer area, the insertable thermal printer cartridge comprising:

a) a housing for receiving a plurality of receivers, each of which is adapted to receive colorant;

b) a donor supply roll to supply a donor having colorant to a colorant transfer area and a donor take-up spool for receiving donor after colorant has been transferred;

c) means for serially moving the receivers to and the donor from the donor from the donor supply roll to the colorant transfer area where colorant is transferred from the donor to the receiver;

e) the housing including identifying contacts which, after the insertable insertable thermal printer cartridge has been inserted into the camera, which provide an electrical connection to identify the type of receiver and donor in the inserted insertable thermal printer cartridge, the housing defining a cavity for mounting at least one battery which is adapted to provide power for the moving means and for supplying power to the thermal printer for activating the printhead for colorant transfer at the colorant transfer area.

3. The invention of claim 2 wherein the camera includes image capturing processing electronics and insertable thermal printer cartridge interface and printer actuator electronics adapted to be electrically connected to a battery in the insertable thermal printer cartridge.

4. The invention of claim 2 wherein the digital camera includes another battery for operating the image capture and processing electronics.

5. The insertable thermal printer cartridge of claim 2 further including a removable seal covering the identifying contacts.

* * * * *